US006409174B1

(12) United States Patent
Demarest

(10) Patent No.: US 6,409,174 B1
(45) Date of Patent: Jun. 25, 2002

(54) 21 DRAW POKER GAME

(76) Inventor: Phillip W. Demarest, 2488 Hoops Ave., Henderson, NV (US) 89102

( * ) Notice: Subject to any disclaimer, the term of this patent is extended or adjusted under 35 U.S.C. 154(b) by 0 days.

(21) Appl. No.: 09/696,192

(22) Filed: Oct. 26, 2000

Related U.S. Application Data

(60) Provisional application No. 60/161,913, filed on Oct. 28, 1999.

(51) Int. Cl.[7] ..... A63F 1/00
(52) U.S. Cl. ..... 273/292; 463/12; 463/13
(58) Field of Search ..... 273/292, 274, 273/309; 463/12, 13

(56) References Cited

U.S. PATENT DOCUMENTS 4,948,134 A * 8/1990 Suttle et al. ..... 273/274
5,988,643 A * 11/1999 Awada ..... 273/292

* cited by examiner

*Primary Examiner*—Benjamin H. Layno
(74) *Attorney, Agent, or Firm*—Piper Rudnick LLP; Wilburn L. Chesser

(57) ABSTRACT

A card game and method of playing that includes two optionally playable rounds, a Blackjack round and a Poker round. The game is playable by one or more players using one or more decks of cards or representations thereof. The game is playable, for example, on a gaming table by players and a dealer using decks of cards, or on a computer or other electronic device using representations of various features of the game. Each player begins by selecting whether to participate in the Blackjack round and the Poker round. The selection is made, for example, by placing bets for each round prior to play beginning. In the Blackjack round, play proceeds in accordance with standard rules of Blackjack, including the option for each player and the dealer to receive more cards. At the completion of the Blackjack round, play proceeds to the Poker round. In the Poker round, each player who busted in the Blackjack round, as well as the dealer, if the dealer busted, receives up to two additional cards, so long as no player or the dealer thereby exceeds five cards. Play then proceeds in accordance with the standard rules of Poker. If the player's hand wins in the Poker round, the house pays the player a return based on a payout table. In play with a gaming table, the table includes various spots or locations for easing play or ensuring proper play, including locations for each player's placement of bets for each round.

23 Claims, 8 Drawing Sheets

FIG. 6

Example Payout Table

| Hand | Return |
|---|---|
| Nothing | -1:1 |
| Ace-9 or better | 0:1 |
| One pair | 2:1 |
| Two pair | 3:1 |
| Three of a kind | 4:1 |
| Straight | 5:1 |
| Flush | 8:1 |
| Full house | 10:1 |
| Four of a kind | 25:1 |
| Straight flush | 100:1 |
| Five of a kind | 250:1 |
| Royal flush | 500:1 |

21 DRAW POKER GAME

This application claims priority to applicant's copending U.S. Provisional Patent Application Serial No. 60/161,913 of Phillip W. DEMAREST entitled "21 DRAW POKER GAME" filed Oct. 28, 1999.

BACKGROUND OF THE INVENTION

1. Field of the Invention

This invention relates to a game, and in particular to a two round casino style game played with at least one deck of cards, the game including a first round played in conjunction with the rules of Blackjack and a second round played with the cards dealt in the first round and optionally dealt additional cards, play of the second round proceeding in accordance with the rules of Poker.

2. Background of the Technology

There is a general problem with new casino style games that are coming onto the market in that allowing play of these games at casinos and elsewhere requires the replacement of existing casino tables. If a new game is particularly unknown or untested, many casinos are reluctant to replace a table with a new game, especially if existing tables regularly produce revenue for the casino.

There is a need for a new casino game that allows the game to be played without displacing existing revenue generating casino game tables, such as Blackjack tables and Poker tables.

There is a further need for casino table games that have multiple rounds or subgames, so that players are encouraged to keep playing the table games because of the likelihood of winning a second round, despite losing the first round. Further, there is a need for a multiple round game that provides generally more entertaining and enjoyable play for the players and provides the players with variety in strategy and options for winning. There is also a need for multiple round games to allow players the possibility of much greater jackpots or other higher potential wins. There is yet a further need to provide a multiple round game that includes rounds of games that are easily learned or well known by most players, thus reducing the need for developed expertise by players.

SUMMARY OF THE INVENTION

It is an advantage of the present invention to meet these needs, and others, by providing a card game having two rounds to provide increased incentive for play of players and variability and sufficient likelihood of return for the house, the rounds being played in accordance with the rules of the well known games of Blackjack and Poker.

It is a further advantage of the present invention to provide for players to select to play in the first round or both the first round and the second round, the first round being played in accordance with Blackjack rules and the second round being played in accordance with Poker rules. It is a further advantage of the present invention to provide for players to select to play by placing bets.

It is yet a further advantage of the present invention to provide a payout in the second round based on comparison to a payout table, allowing higher possible returns for players.

It is yet another advantage of the present invention to provide a gaming table and layout for play of the game. It is yet another advantage of the present invention to provide for electronic or otherwise automated play of the game, including play with a slot machine.

The present invention comprises a card game and method of playing that includes two optionally playable rounds. The game is playable by one or more players using one or more decks of cards or representations thereof. The game is playable, for example, on a gaming table by players and a dealer using a deck or decks of cards, or on a computer or other electronic medium using representations of various features of the game. Each player begins by selecting whether to participate in the Blackjack round, and if selecting to play in the Blackjack round, selecting whether to also play in the Poker round. The selection is made, for example, by placing bets for each round prior to play beginning. In a Blackjack round, which is played first, two cards are dealt to each player and to the dealer sequentially, the cards being dealt to each player and the dealer face up or face down, such as both cards face up, both cards face down, or one card up and one card down. Play of the Blackjack round then proceeds in accordance with the rules of Blackjack. Play includes the option for each player and the dealer to receive additional cards. At the completion of the dealing of cards for the Blackjack round, play proceeds to the Poker round for each player having elected to play in the Poker round. In the Poker round, each player who busts, as well as the dealer, if the dealer busts, receives up to two additional cards, so long as neither any player receiving additional cards nor the dealer receiving additional cards has more than five cards. Each player hand is then compared to the dealer's hand in accordance with the standard rules of Poker. If the player's hand wins, the house pays the player a return based on a payout table. Betting minimums and maximums, as well as payout table odds are variably determined depending on mathematical probabilities and preferable odds selected by the house. In play with a gaming table, the table includes various spots or locations for easing play or ensuring proper play, including a location for placement of the Blackjack round bet and the Poker round bet for each player.

To achieve the stated and other advantages of the present invention, as embodied and described below, the invention includes a method for at least one player and a dealer to play a card game with a plurality of cards, the card game including a Blackjack round and a Poker round, the method comprising: playing the Blackjack round in accordance with rules of Blackjack, the Blackjack round including: sequentially dealing a first card to each player and a first card to the dealer; sequentially dealing a second card to each player and a second card to the dealer; providing an option to receive additional cards to each of the at least one player and the dealer; dealing additional cards to each of the at least one player and the dealer selecting to receive additional cards, in accordance with the rules of Blackjack, such that each player has a player Blackjack round hand and the dealer has a dealer Blackjack round hand; playing the Poker round in accordance with rules of Poker, wherein each player participating in the Poker round plays with the player Blackjack round hand, and the dealer plays with the dealer Blackjack round hand, the Poker round including: dealing up to two additional cards to each player and the dealer having a bust hand in the Blackjack round, such that each player participating in the Poker round and receiving the up to two additional cards has no more than five cards, wherein each player participating in the Poker round and the dealer have a Poker round hand; and determining whether each participating player wins the Blackjack round and the Poker round. To achieve the stated and other advantages of the present invention, as embodied and described below, the invention further includes a method for a player to play a card game with representations of a deck of cards, the game having a Blackjack round and a Poker round, comprising: playing the Blackjack round in accordance with rules of Blackjack, the Blackjack round including: assigning a first card to the player and a first card to a dealer; assigning a second card to the player and a second card to the dealer; providing an option to receive additional cards to the player and to the dealer; assigning additional cards to each of the at least one player and assigning to the dealer additional cards, in accordance with the rules of Blackjack, such that each player has a player Blackjack round hand and the dealer has a dealer Blackjack round hand; playing the Poker round in accordance with rules of Poker, wherein each player participating in the Poker round plays with the player Blackjack round hand, and the dealer plays with the dealer Blackjack round hand, the Poker round including: determining whether the player and the dealer have bust hands; if the player has a bust hand, assigning up to two additional cards to the player, such that the player participating in the Poker round and receiving the up to two additional cards has no more than five cards, wherein the player participating in the Poker round has a Poker round hand; if the dealer has a bust hand, assigning up to two additional cards to the dealer, such that the dealer receiving the up to two additional cards has no more than five cards, wherein the dealer has a Poker round hand; and determining whether the player wins the Blackjack round and the Poker round.

To achieve the stated and other advantages of the present invention, as embodied and described below, the invention further includes a gaming table for at least one player and a dealer to play a card game with at least one deck of cards, the game having a Blackjack round and a Poker round, the gaming table comprising: a table surface; at least one player location indicated on the table surface, each of the at least one player location including: an indicated Blackjack round bet location; an indicated Poker round bet location; and a dealer location indicated on the table surface; wherein the Blackjack round is played in accordance with rules of Blackjack, the Blackjack round including: sequentially dealing a first card to each player and a first card to the dealer; sequentially dealing a second card to each player and a second card to the dealer; providing an option to receive additional cards to each of the at least one player and the dealer; dealing additional cards to each of the at least one player and the dealer selecting to receive additional cards, in accordance with the rules of Blackjack, such that each player has a player Blackjack round hand and the dealer has a dealer Blackjack round hand; wherein the Poker round is played in accordance with rules of Poker, wherein each player participating in the Poker round plays with the player Blackjack round hand, and wherein the dealer plays with the dealer Blackjack round hand, the Poker round including: dealing up to two additional cards to each player and the dealer having a bust hand in the Blackjack round, such that each player participating in the Poker round and receiving the up to two additional cards has no more than five cards, wherein each player participating in the Poker round and the dealer have a Poker round hand; and wherein a determination is made as to whether each participating player wins the Blackjack round and the Poker round.

To achieve the stated and other advantages of the present invention, as embodied and described below, the invention further includes a device for a player to play a card game with representations of a deck of cards, the game having a Blackjack round and a Poker round, the device comprising: a display for displaying the card game, including the representations of a standard deck of cards; and a processor for receiving selections from the player for play of the game, for determining progress of play, and for processing and displaying a graphical user interface; wherein the Blackjack round is played in accordance with rules of Blackjack, the Blackjack round including: sequentially dealing a first card to each player and a first card to the dealer; sequentially dealing a second card to each player and a second card to the dealer; providing an option to receive additional cards to each of the at least one player and the dealer; dealing additional cards to each of the at least one player and the dealer selecting to receive additional cards, in accordance with the rules of Blackjack, such that each player has a player Blackjack round hand and the dealer has a dealer Blackjack round hand; wherein the Poker round is played in accordance with rules of Poker, wherein each player participating in the Poker round plays with the player Blackjack round hand, and wherein the dealer plays with the dealer Blackjack round hand, the Poker round including: dealing up to two additional cards to each player and the dealer having a bust hand in the Blackjack round, such that each player participating in the Poker round and receiving the up to two additional cards has no more than five cards, wherein each player participating in the Poker round and the dealer have a Poker round hand; and wherein a determination is made as to whether each participating player wins the Blackjack round and the Poker round.

Additional advantages and novel features of the invention will be set forth in part in the description that follows, and in part will become more apparent to those skilled in the art upon examination of the following or upon learning by practice of the invention.

DESCRIPTION OF THE FIGURES

In the drawings:

FIG. 6 presents an example payout table in accordance with an embodiment of the present invention.

DETAILED DESCRIPTION OF THE INVENTION

Figure 1:
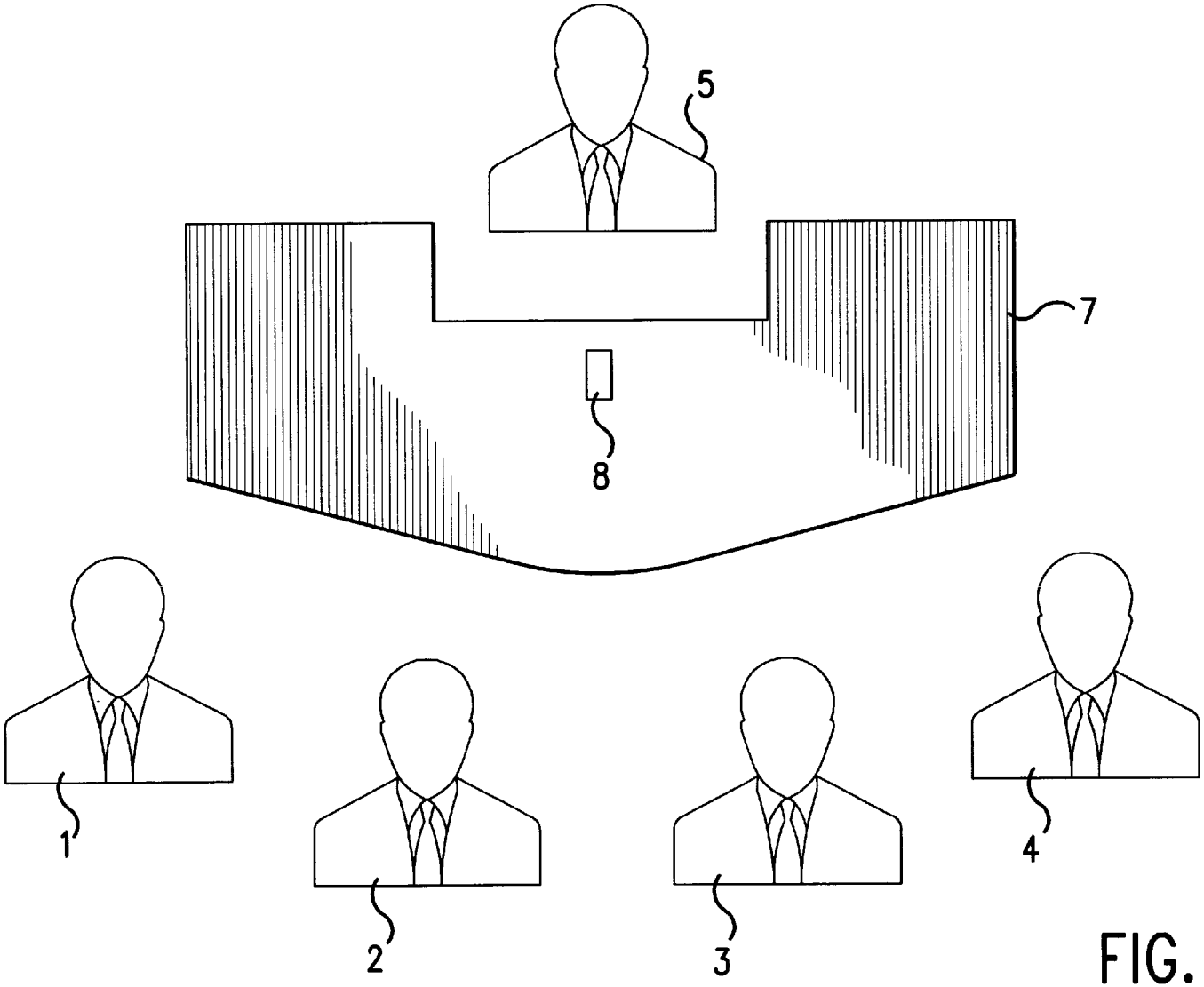
FIG. 1 is an overhead view of the players, dealer, and gaming table for play of the game in accordance one embodiment of the present invention.

The present invention provides a casino style game having two rounds, the two rounds being based upon the standard casino games of Blackjack and Poker. The present invention thus allows play of the game of the present invention or play of standard revenue producing games such as Blackjack and Poker without requiring the casino to replace tables for play of the standard games. The present invention thus provides a new game while also saving the casino money and risk of reduced revenue from existing tables.

Further, because the present invention includes two games with successively obtainable jackpots, while play of the game keeps the realistic likelihood of the higher jackpot hand relatively low, players are provided the possibility of larger jackpots than existing table games without reducing the likelihood of high casino returns for the game.

Play in accordance with one embodiment of the present invention occurs on a standard casino gaming table. The layout of the table includes marked areas for one or more players. Each player area includes two betting locations, one for betting on the Blackjack round and the other for betting on the Poker round. In an embodiment of the present invention, players are able to play only the Blackjack round and play and bet in accordance with the standard rules for Blackjack using only the Blackjack betting location. Players are also able to play both Blackjack and Poker in the combined game. However, players are not permitted to play the Poker round without playing the Blackjack round.

In an embodiment of the present invention, the Blackjack round is played in accordance with the standard rules for Blackjack, and the Poker round is played in accordance with standard rules for Poker.

Play of the game, in accordance with an embodiment of the present invention, proceeds as follows. Players indicate their selection to participate in the game by placing at least an initial wager on the Blackjack round of the game. This initial wager is made, for example, in accordance with play with a gaming table of the present invention, by placing a bet on the Blackjack betting spot on the gaming table.

In an embodiment of the present invention, the player also optionally selects whether to play the Poker round of game at the same time the player places the initial bet for the Blackjack (marked "BJ") round. Selection to play in the Poker round, in addition to the Blackjack round, is made, for example, by placing a bet on the Poker (marked "PK") betting spot on the gaming table.

In an embodiment of the present invention, the amount of the wager for the Blackjack round is selected by player and, for example, must fall within the ranges for minimum and maximum bets as typically set by casinos. In addition, in an embodiment of the present invention, if the player selects to play both the Blackjack round and the Poker round, the player must place a Poker bet that is up to half (½) of the blackjack bet.

After the placement of wagers, in an embodiment of the present invention, cards are dealt for the Blackjack round to each player electing to play. In accordance with standard rules of Blackjack, each player is dealt cards sequentially, beginning with the player to the immediate left the dealer, and proceeding clockwise about the table. The dealer, for example, deals a first card face up or down to each participating player, and one card face down to the dealer. The dealer then deals a second card face up or down to each player, and a card face up or face down to the dealer. Each subsequent card dealt to the players or the dealer are also dealt face up or face down, depending, for example, on the preferences of the house. The game is playable with a single or multiple decks of cards using, for example, a card shoe, in which multiple decks are held and cards are dealt one at a time by removal from the shoe.

In play in accordance with one embodiment of the present invention, if the dealer is dealt an Ace face up, each player is provided with the option to obtain insurance, in accordance with standard rules of Blackjack. Players signify the selection to buy insurance by placing an extra wager equal to up to one half the Blackjack wager. In an embodiment of the present invention the gaming table includes a betting spot indicating that "Insurance Pays 2:1." Insurance thus pays 2:1 in accordance with standard rules of Blackjack. With insurance play, if the dealer has a natural Blackjack, players electing to buy insurance receive a return of 2:1 on their insurance bet, but lose their initial bets. If the dealer does not have a natural Blackjack, players buying insurance lose their insurance bet.

Play of the Blackjack round then continues in accordance with the standard rules of Blackjack. Each player elects to stand (play with the cards received) or to receive additional cards ("hits") until the player elects to stand or busts (player hand exceeds "21"). Players may also split, double down, and make other play selections in accordance with the standard rules of Blackjack.

When all players have completed their play in the Blackjack round, the dealer plays. In the dealer's play, the dealer begins by turning the dealer's face down card face up. The dealer then elects to either continue to hit or to stand. When the dealer has completed play, the Blackjack round is complete. Players having a bust hand lose their Blackjack round wagers.

In an embodiment of the present invention, if a dealer has a soft 17 or less (i.e., has an Ace counted as a high card to produce a total of 17 or less), the dealer is required to take additional cards that equal at least a hard 17 (i.e., a hand having an Ace counted as a low and a total card count of at least 17) or a maximum card count of 21 (counting the Ace as a high). When a dealer busts, all remaining (i.e., non-busting and non-folding or surrendering) Blackjack round hands of players are winners.

In an embodiment of the present invention, if a player elects to split equal value cards received, in accordance with standard Blackjack rules, that player must place a second Blackjack round bet equal to that player's first Blackjack round bet. That player must also place a second wager for the Poker round equal to the initial Poker round bet. By splitting in the game of the present invention, a player thus proceeds to play with two hands in both the Blackjack round and the Poker round, if so initially selected.

In an embodiment of the present invention, the dealer does not look at the face down card in the event that a 10 card is showing, as typically occurs at many casinos to determine whether the dealer has Blackjack. This procedure is often followed to shorten play in the event that the dealer has a natural Blackjack. However, with the present invention, such play is not allowed because of the need to continue play in the Poker round.

Once each player has completed play in the Blackjack round, play proceeds to the Poker round. In the Poker round, each player who busted in the Blackjack round of play receives up to two additional cards to the cards dealt that player in the Blackjack round. However, the number of additional cards each bust hand player receives cannot cause that player to exceed a total hand of five cards. Thus, for example, if a player busted after receiving three cards in the Blackjack round, the player receives two additional cards, for a total of five cards for the Poker round. If a player busted upon receiving four cards in the Blackjack round, the player receives one additional card, for a total of five cards for the Poker round. If a player busted when receiving five or more cards in the Blackjack round, the player receives no additional cards for the Poker round.

As with the players, a dealer who busts receives no more than two additional cards for a total of no more than five cards for the dealer's Poker round hand. If the dealer has received five or more cards and has not busted, the dealer, like the players, is not entitled to receive any more cards for the Poker round.

The dealer then announces to the table the dealer's card count for the Blackjack game, followed by the dealer's highest ranking Poker hand. For example, if the dealer has two Jacks, the dealer has 20 for the Blackjack round, and a pair of Jacks in the Poker round. Starting on the dealer's right, the dealer then proceeds from player to player, first determining whether each player has a winning Blackjack round hand, and then determining whether each player has a winning Poker round hand. All winnings are settled at the end of play in order to avoid confusion and possible improper play by players, as could occur if bets were settled after each round.

For each player who has wagered on the Poker game, the player's hand ranking in accordance with the rules of Poker is announced, and each winning player is paid a return on the Poker round bet in accordance with a payout table. Up to the five best cards of each Poker round player are compared to the dealer's up to five best cards. Each player whose hand exceeds the dealer's hand for Poker wins the Poker round. Each player losing in the Poker round loses the Poker round wager to the house. The dealer continues counterclockwise until all players' hands have been verified by the dealer.

In the example in which the dealer has two Jacks, each player having a card total of more than 20, but not busting, wins and is paid a 1:1 return in the Blackjack round. For example, if a player bet five dollars in each round, and wins in the Blackjack round, the player receives a five dollar return on the Blackjack hand. If the player's total is less than 20 or is a bust, the player loses and the Blackjack round wager is lost to the house. In the Poker round, each player having at least a Ace Nine, (Qualifier) or better, in accordance with the standard rules of Poker, wins and is paid according to a payout schedule. For example, for the player betting 2:1, if the player has a pair of Queens, the player receives a five dollar return in the Poker round. If the player has less than Jacks, the hand is considered lost and the Poker round wager is lost to the house.

In an embodiment of the present invention, in order to assure proper play, additional verification of high ranking player hands is conducted. For example, if any player wagering in the Poker round wins with a five card flush hand, or better, the hand must be verified by a casino supervisor before the return on the bet is paid.

The game is also playable with representations of any of the features described. For example, the game is playable in an electronic or partially electronic manner using a terminal, such as a personal computer, microcomputer, minicomputer, mainframe computer, or other device having a processor and display, such as an electronic hand-held game device, for which representative images of cards are displayable on a screen via a graphical user interface (GUI), or using, for example, a slot machine. The game is also playable in conjunction with performance of selected functions on a network, such as the Internet or an intranet.

An embodiment of the present invention includes return using a payout table for players having winning hands in the Poker round of the game. With the use of a payout table, a variable ratio payback is paid to each player depending on the player's hand. For example, in one embodiment, the payout table includes varying returns for hands with Qualifier (Ace Nine or higher), a pair, two pair, three of a kind, a five card straight, a five card flush, a five card Royal flush, and five of a kind. These returns may include, for example, push, 2:1, or 3:1 or greater paybacks, depending on the hand. In an embodiment of the present invention, the returns in the payout table are determined using a mathematical formula to assure a predetermined likelihood of house returns. No return, however, is paid to players having losing hands versus the dealer, regardless of the payout table return indicated; only winning hands versus the dealer are paid.

The game table used conjunction with an embodiment of the present invention is a standard blackjack or poker sized casino table, in which a dealer occupies one side of the table and players occupy the other. In one embodiment, the table includes a bar located on the dealer's side of the table. The table also includes the name of the game, "21 Draw Poker" or "21 Draw Poker Qualify."

References will now be made in detail to embodiments of the present invention, examples of which are illustrated in the accompanying drawings.

FIG. 1 is an overhead view of the players, dealer, and gaming table for play of the game in accordance one embodiment of the present invention. FIG. 1 shows an embodiment of the game as played with one or more players 1, 2, 3, 4 and a dealer 5 at a gaming table 7 using one or more decks of cards located at a card location 8.

Figure 2:
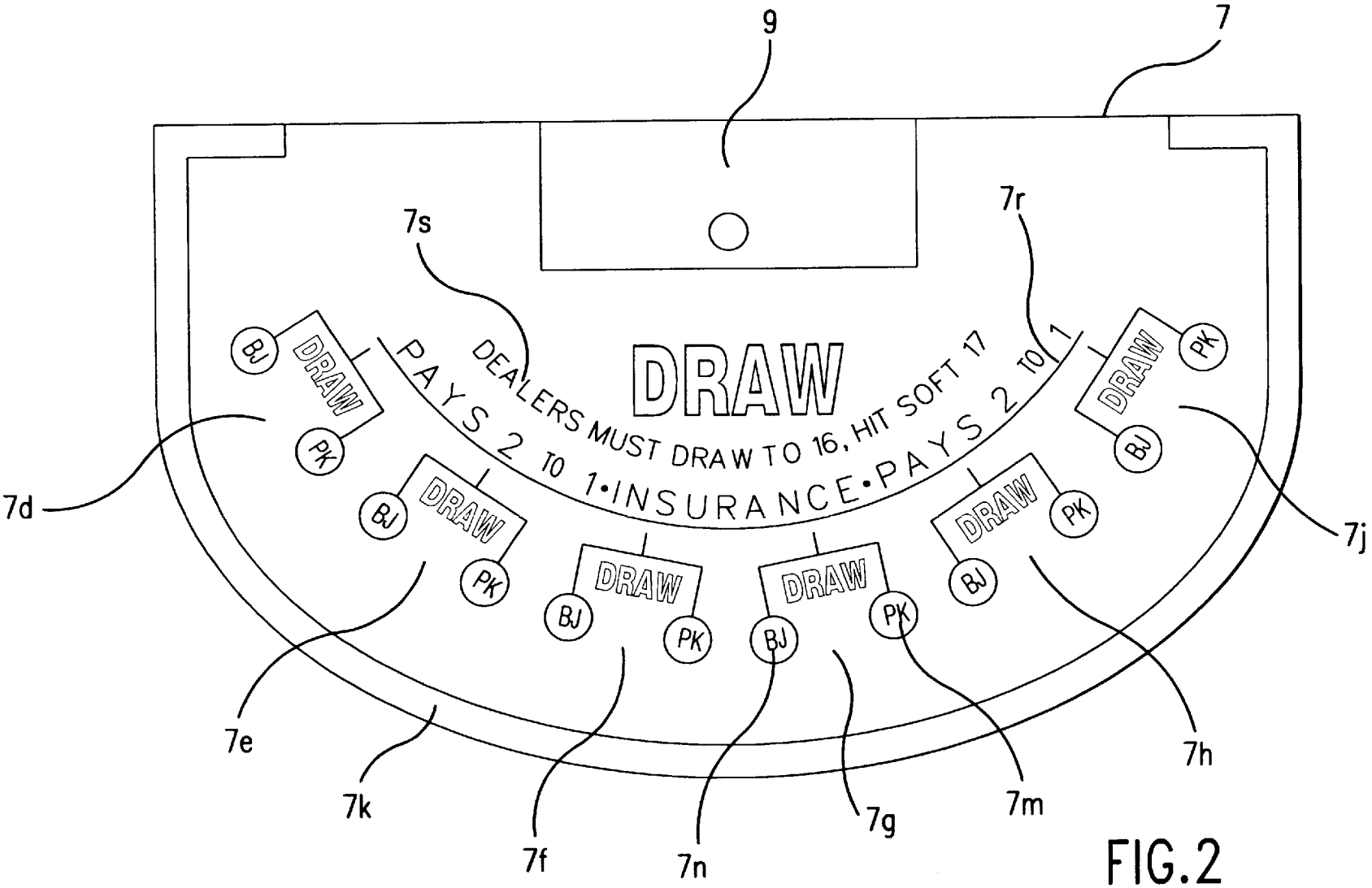
FIG. 2 presents a gaming table layout for a gaming table in accordance with an embodiment of the present invention.

FIG. 2 presents a gaming table layout for a gaming table in accordance with the embodiment of the present invention. As shown in FIG. 2, the table 7 includes a dealer play area 9 and a number of player areas 7*d*, 7*e*, 7*f*, 7*g*, 7*h*, 7*j* on the players' side of the table, the lower side of the table as shown in FIG. 2. Each player area 7*d*, 7*e*, 7*f*, 7*g*, 7*h*, 7*j* includes two marked areas, a Blackjack round betting spot marked "BJ" 7*n* for placement of a Blackjack round wager, and a Poker round betting spot marked "PK" 7*m* for placement of a Poker round wager. In addition, the table includes areas indicating "Insurance Pays 2:1" 7*r* and indicating "Dealers must draw to 16, hit soft 17" 7*s*.

Figure 3:
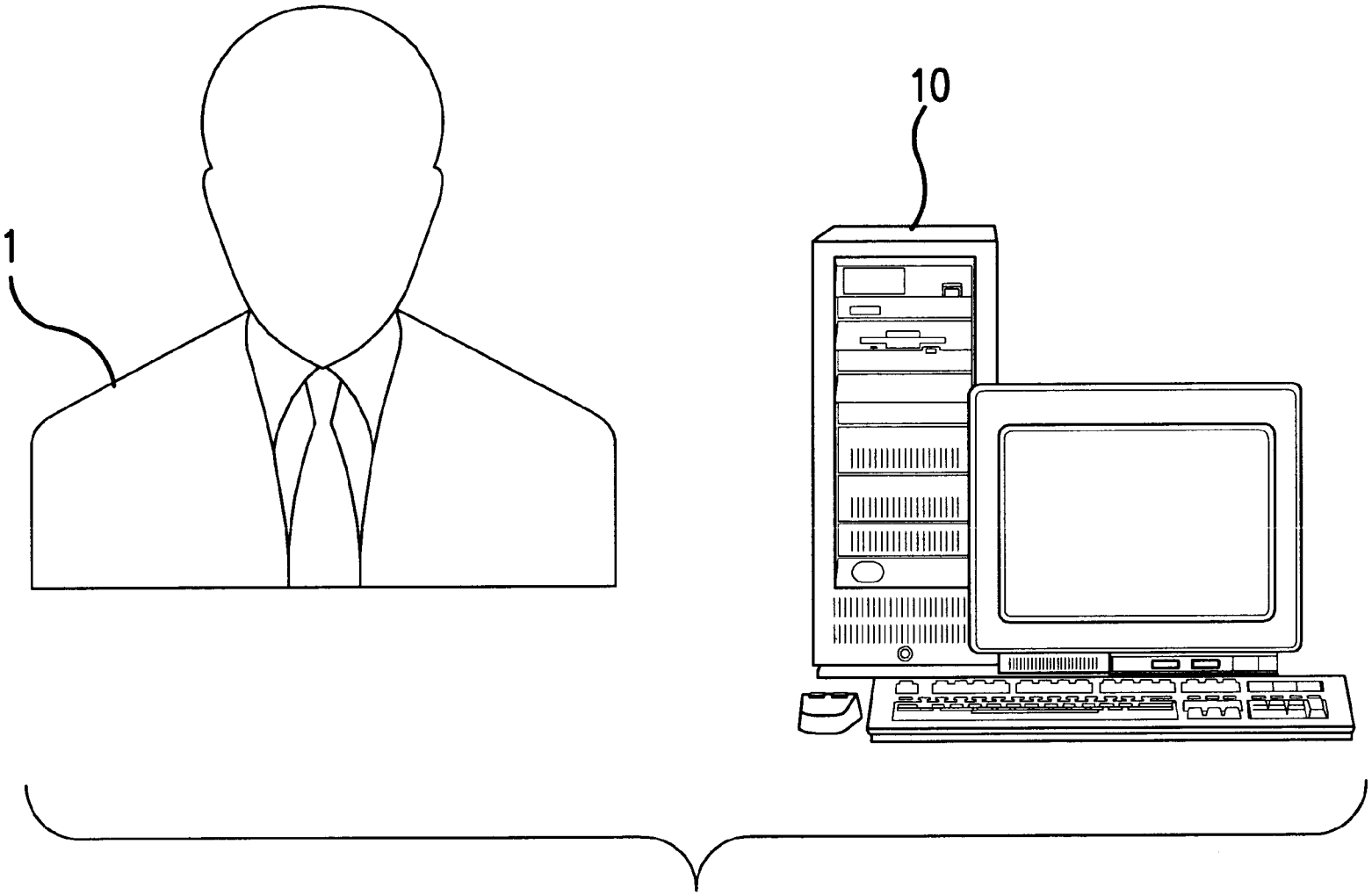
FIG. 3 depicts the components for processor based play of the game in accordance with one embodiment of the present invention.

FIG. 3 depicts the components for processor based play of the game in accordance with one embodiment of the present invention. As shown in FIG. 3, in this embodiment, the player 1 plays at a terminal 10, such as a personal computer, a minicomputer, a microcomputer, a main frame computer, or other device having a display, processor, and GUI, including a hand-held electronic game.

Figure 4:
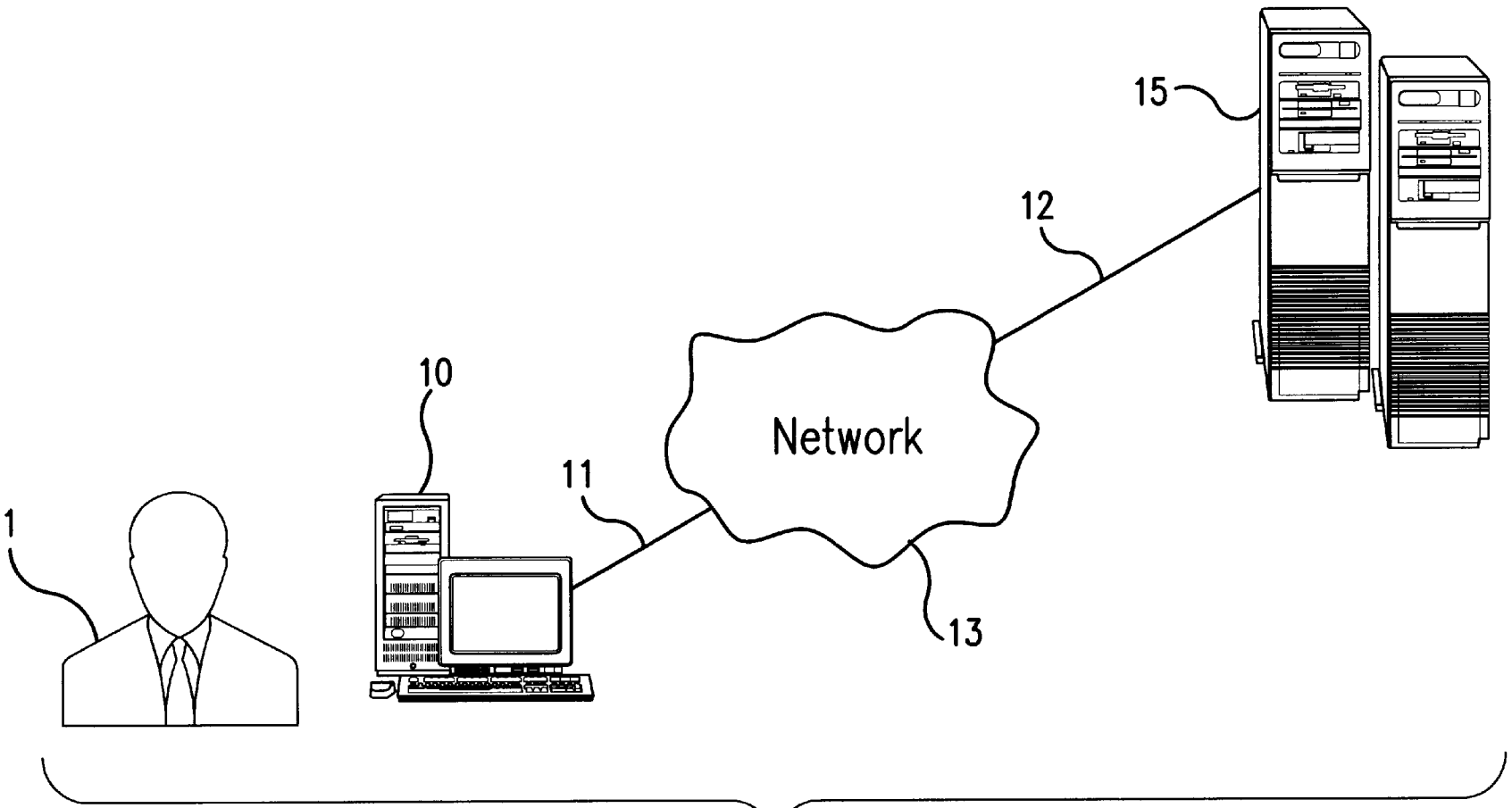
FIG. 4 presents components for play of the game using a processor on a network in accordance with another embodiment of the present invention.

FIG. 4 presents components for play of the game using a processor on a network, such as the Internet or an intranet, in accordance with another embodiment of the present invention. As shown in FIG. 4, a player 1 plays at a terminal 10, such as a personal computer, a minicomputer, a microcomputer, a main frame computer, or other device having a display and processor. The terminal 10, is connected 11, 12 via, for example, wire, wireless, or fiberoptic coupling to a network 13, such as the Internet or an intranet, to a server 15, such as personal computer, a minicomputer, a microcomputer, a main frame computer, or other device having a processor.

Figure 5A:
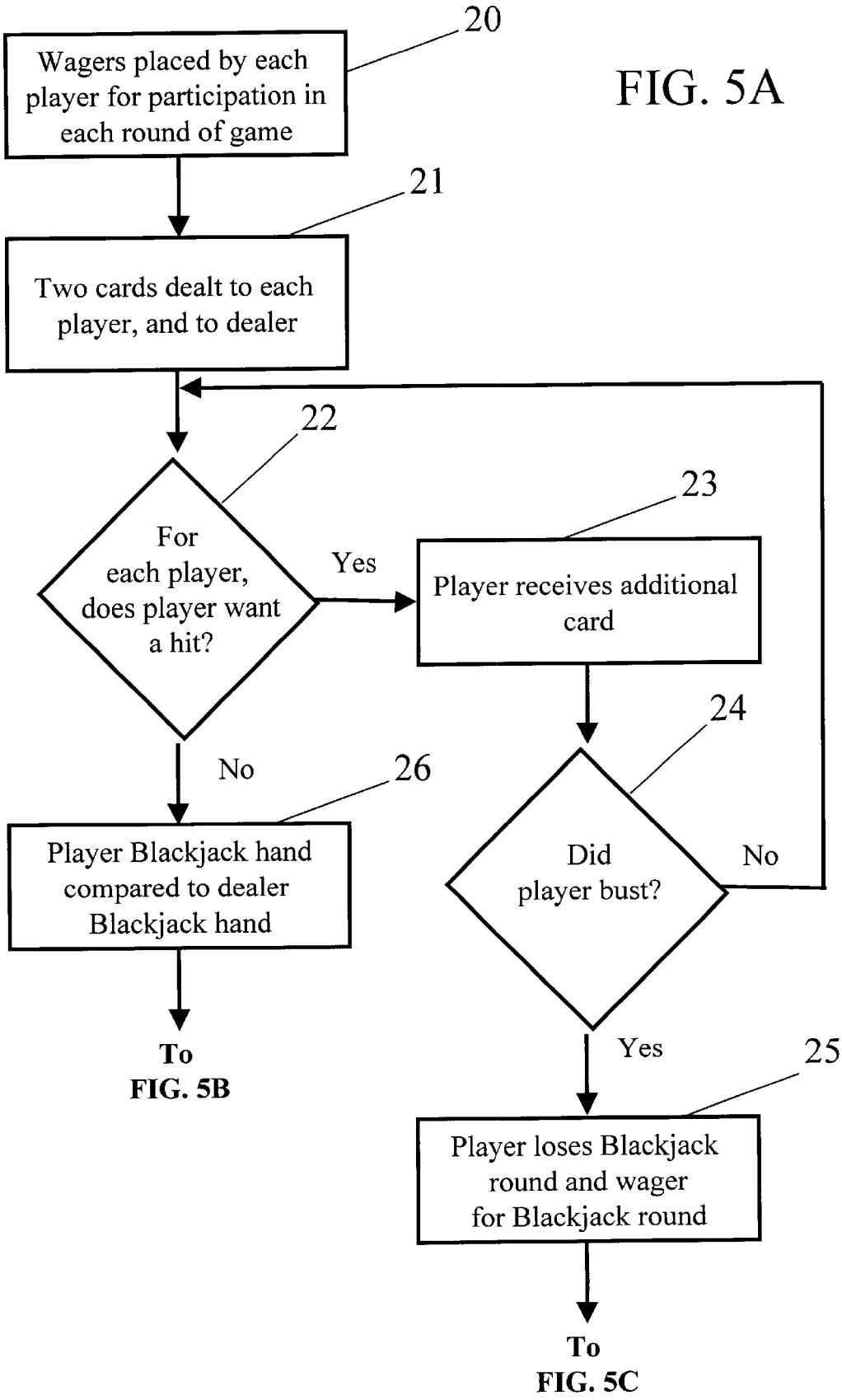
FIGS. 5A–5C show a flow diagram of an example method of play in accordance with an embodiment of the present invention.
Figure 5B:
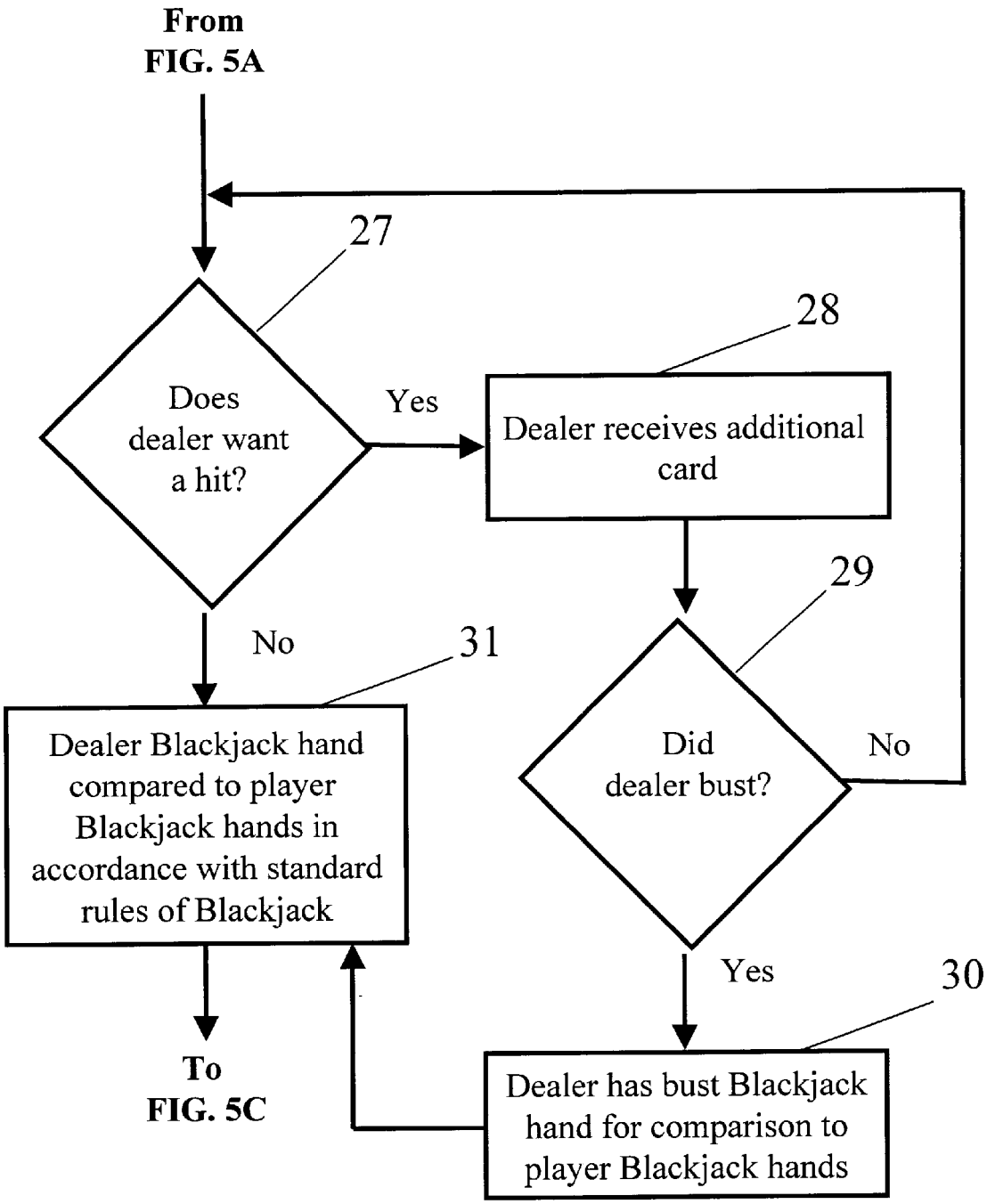
Figure 5C:
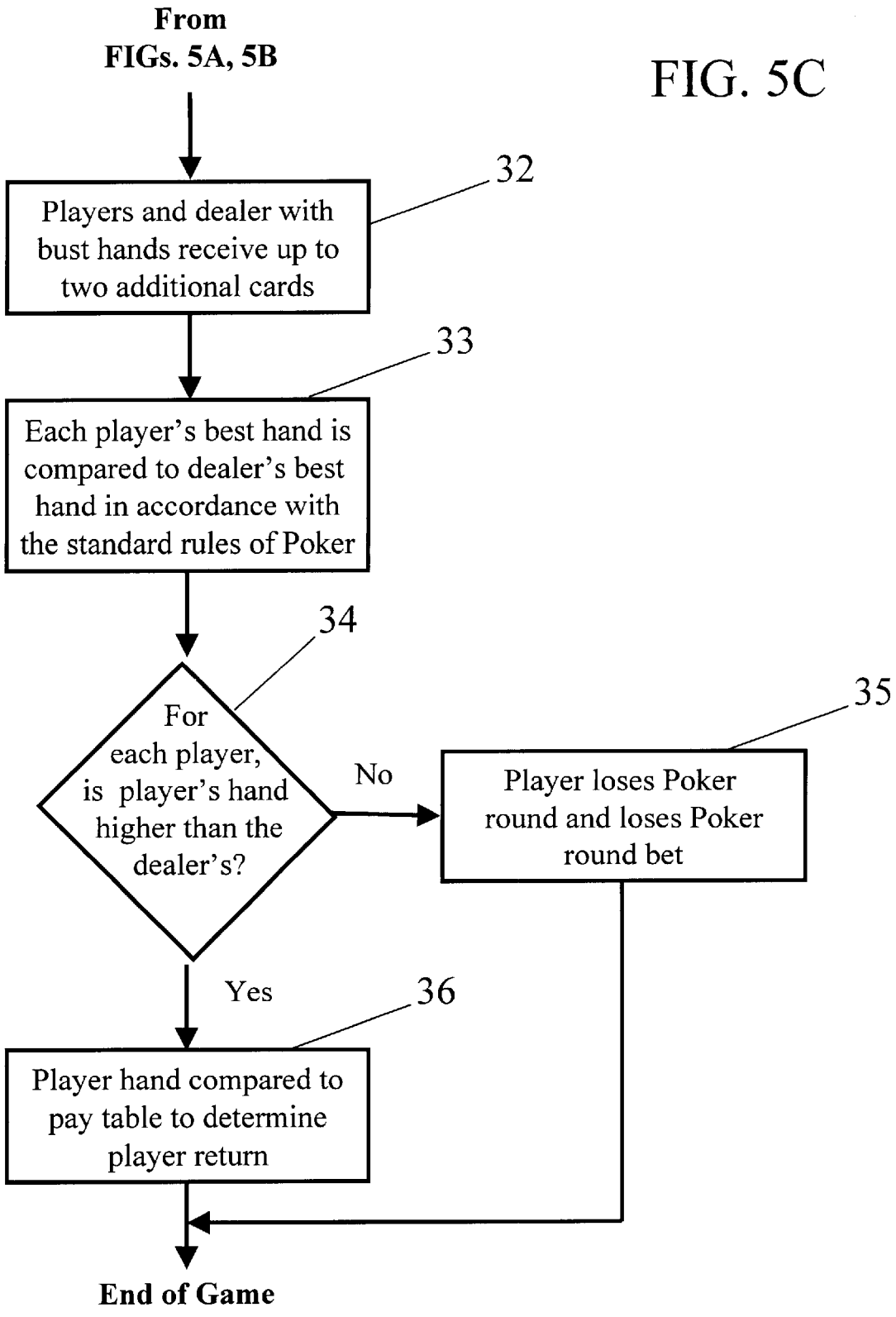

FIGS. 5A–5C show a flow diagram of an example method of play in accordance with an embodiment of the present invention. As shown in FIG. 5A, play begins with each of the players placing wagers for participation in each round of the game 20. In an embodiment of the present invention, a wager must be placed for the Blackjack round in order for the player to participate, and a wager up to half (½) of the blackjack bet placed for the Poker round if the player selects to participate in both the Blackjack round and the Poker round.

Two cards are dealt to each player and to the dealer sequentially, the cards being dealt face down, face up, or both face down and face up, for example 21. Play then proceeds in accordance with standard rules for Blackjack. A determination is then made by each player as to whether to receive another card, referred to as a "hit" 22. If the player elects to receive an additional card, the card is provided to the player 23. A determination is then made as to whether the player busted 24. If the player busted, the player loses the Blackjack round and loses the Blackjack round wager 25, and play proceeds to the Poker round for the player, as shown in FIG. 5C.

If the player did not bust upon receiving the additional card, the player is provided with another option to receive a hit 22. If the player elects not to take a hit, the player's Blackjack hand is compared to the dealer's Blackjack hand 26, as shown in FIG. 5B.

As shown in FIG. 5B, before comparing the player's Blackjack hand to the dealer's Blackjack hand, the dealer's Blackjack hand is determined. First, the dealer makes a selection as to whether to receive a hit 27. If the dealer elects to receive a hit, the dealer receives an additional card 28. A determination is then made as to whether the dealer busted 29. If the dealer busted, the dealer has a bust hand for comparison to the players' hands for the Blackjack round 30. If the dealer did not bust upon receiving the additional card, the dealer is provided with another option to receive a hit 27. The dealer Blackjack hand is then compared to the player Blackjack hands in accordance with the standard rules of Blackjack 31.

Play then proceeds to the Poker round, as shown in FIG. 5C. As shown in FIG. 5C, the players and dealer having bust hands initially receive up to two additional cards 32. However, neither the bust hand players nor the dealer can receive additional cards, such that these players or dealer has more than five cards. Each player's best hand is then compared to the dealer's best hand in accordance with the standard rules of Poker 33. The best hand is the best five card hand, determined for players having more than five cards, in accordance with the standard rules of Poker. In one embodiment, the two rounds are played concurrently, player by player.

A determination is then made for each player as to whether each player's best Poker hand is better than the dealer's best Poker hand 34. If the player's Poker hand is not better than the dealer's Poker hand, the player loses the Poker round and loses the Poker round bet 35. If the player's Poker hand is better than the dealer's Poker hand, the player hand is compared to a payout table to determine the player's return on the wager 36.

FIG. 6 presents an example payout table in accordance with an embodiment of the present invention. As shown in FIG. 6, in this example, for a winning player, high card and one pair pays 1:1: two pair pays 2:1; three of a kind pays 3:1, a five card straight pays 5:1; a five card flush pays 6:1; a full house pays 8:1; four of a kind pays 10:1; a five card straight flush pays 25:1; and a Royal flush pays 1,000:1. Other returns are also usable, as the house prefers.

Example embodiments of the present invention have now been described in accordance with the above advantages. It will be appreciated that these examples are merely illustrative of the invention. Many variations and modifications will be apparent to those skilled in the art.

What is claimed is:

1. A method for at least one player and a dealer to play a card game with a plurality of cards, the card game including a Blackjack round and a Poker round, the method comprising:

playing the Blackjack round in accordance with rules of Blackjack, the Blackjack round including:

sequentially dealing a first card to each player and a first card to the dealer;

sequentially dealing a second card to each player and a second card to the dealer;

dealing additional cards to each of the at least one player and the dealer selecting to receive additional cards, in accordance with the rules of Blackjack, such that each player has a player Blackjack round hand and the dealer has a dealer Blackjack round hand;

playing the Poker round in accordance with rules of Poker, wherein each player participating in the Poker round plays with the player Blackjack round hand, and the dealer plays with the dealer Blackjack round hand, the Poker round including:

only for each player and the dealer having a bust hand in the Blackjack round, dealing up to two additional cards to the bust hand player and the dealer, such that each player participating in the Poker round and the dealer receiving the up to two additional cards has no more than five cards, wherein each player participating in the Poker round and the dealer have a Poker round hand; and determining whether each participating player wins the Blackjack round and the Poker round.

2. The method of claim 1, further comprising:

receiving a selection from each player as to whether to participate in the Blackjack round.

3. The method of claim 2, wherein receiving the selection from each player includes:

receiving from each player a bet.

4. The method of claim 1, further comprising:

receiving a selection from each player as to participate in the Poker round.

5. The method of claim 4, wherein receiving the selection from each player includes:

receiving from each player a bet for the Blackjack round and a bet for the Poker round.

6. The method of claim 5, wherein the bet for the Poker round is up to ½ of the bet for the blackjack round.

7. The method of claim 1, wherein determining whether each participating player wins the Blackjack round and the Poker round, further comprises:

comparing the Blackjack round hand for each player to the Blackjack round hand for the dealer; and comparing the Poker round hand for each player participating in the Poker round to the Poker hand for the dealer.

8. The method of claim 7, further comprising:

determining whether the Blackjack round hand for each player beats the Blackjack round hand for the dealer, in accordance with the rules of Blackjack, wherein each player having a Blackjack round hand that beats the Blackjack round hand of the dealer wins the Blackjack round.

9. The method of claim 8, further comprising:

paying a Blackjack return to each player winning the Blackjack round.

10. The method of claim 7, further comprising:

determining whether the Poker round hand for each player beats the Poker round hand for the dealer, in accordance with the rules of Poker, wherein each player having a Poker round hand that beats the Poker round hand of the dealer wins the Poker round.

11. The method of claim 10, further comprising:

paying a Poker return to each player winning the Poker round.

12. The method of claim 11, wherein the Poker return is determined using a payout table.

13. The method of claim 12, wherein the payout table pays at odds greater than 1:1 to each player winning the Poker round and having a Poker hand selected from a group consisting of a Qualifier, one pair, two pair, three of a kind, five card straight, five card flush, full house, four of a kind, five card straight flush, Royal flush, and five of a kind as determined in accordance with the standard rules of Poker.

14. The method of claim 1, wherein, for each player participating in the Poker round, determining the Poker round hand for each participating player.

15. The method of claim 14, wherein determining the Poker round hand for each Poker round participating player includes:

determining a total number of cards dealt to each Poker round participating player; and identifying a best Poker hand for each Poker round participating player.

16. The method of claim 15, wherein the best Poker hand includes a maximum of five cards.

17. The method of claim 15, wherein the best Poker hand is determined in accordance with the rules of Poker.

18. A method for a player to play a card game with representations of a deck of cards, the game having a Blackjack round and a Poker round, comprising:

playing the Blackjack round in accordance with rules of Blackjack, the Blackjack round including:

assigning a first card to the player and a first card to a dealer;

assigning a second card to the player and a second card to the dealer;

providing an option to receive additional cards to the player and to the dealer;

assigning additional cards to each of the at least one player and assigning to the dealer additional cards, in accordance with the rules of Blackjack, such that each player has a player Blackjack round hand and the dealer has a dealer Blackjack round hand;

playing the Poker round in accordance with rules of Poker, wherein each player participating in the Poker round plays with the player Blackjack round hand, and the dealer plays with the dealer Blackjack round hand, the Poker round including:

determining whether the player and the dealer have bust hands;

only if the player has a bust hand, assigning up to two additional cards to the player, such that the player participating in the Poker round and receiving the up to two additional cards has no more than five cards, wherein the player participating in the Poker round has a Poker round hand;

only if the dealer has a bust hand, assigning up to two additional cards to the dealer, such that the dealer receiving the up to two additional cards has no more than five cards, wherein the dealer has a Poker round hand; and determining whether the player wins the Blackjack round and the Poker round.

19. The method of claim 18, wherein the representations of the cards are displayed on a terminal.

20. The method of claim 19, wherein the terminal includes a processor.

21. The method of claim 19, wherein the terminal comprises one selected from a group consisting of a personal computer, a minicomputer, a microcomputer, a main frame computer, and a slot machine.

22. A gaming table for at least one player and a dealer to play a card game with at least one deck of cards, the game having a Blackjack round and a Poker round, the gaming table comprising:

a table surface;

at least one player location indicated on the table surface, each of the at least one player location including:

an indicated Blackjack round bet location;

an indicated Poker round bet location; and a dealer location indicated on the table surface;

wherein the Blackjack round is played in accordance with rules of Blackjack, the Blackjack round including:

sequentially dealing a first card to each player and a first card to the dealer;

sequentially dealing a second card to each player and a second card to the dealer;

providing an option to receive additional cards to each of the at least one player and the dealer;

dealing additional cards to each of the at least one player and the dealer selecting to receive additional cards, in accordance with the rules of Blackjack, such that each player has a player Blackjack round hand and the dealer has a dealer Blackjack round hand;

wherein the Poker round is played in accordance with rules of poker, wherein each player participating in the Poker round plays with the player Blackjack round hand, and wherein the dealer plays with the dealer Blackjack round hand, the Poker round including:

only for each player and the dealer having a bust hand in the Blackjack round, dealing up to two additional cards to the player and the dealer, such that each player participating in the Poker round and the dealer receiving the up to two additional cards has no more than five cards, wherein each player participating in the Poker round and the dealer have a Poker round hand; and wherein a determination is made as to whether each participating player wins the Blackjack round and the Poker round.

23. A device for a player to play a card game with representations of a deck of cards, the game having a Blackjack round and a Poker round, the device comprising:

a display for displaying the card game, including the representations of a standard deck of cards; and a processor for receiving selections from the player for play of the game, for determining progress of play, and for processing and displaying a graphical user interface;

means for playing in the Blackjack round in accordance with rules of Blackjack, the means for playing the Blackjack round including:

means for sequentially dealing a first card to each player and a first card to the dealer;

means for sequentially dealing a second card to each player and a second card to the dealer;

means for providing an option to receive additional cards to each of the at least one player and the dealer;

means for dealing additional cards to each of the at least one player and the dealer selecting to receive additional cards, in accordance with the rules of Blackjack, such that each player has a player Blackjack round hand and the dealer has a dealer Blackjack round hand;

means for playing the Poker round in accordance with rules of Poker, wherein each player participating in the Poker round plays with the player Blackjack round hand, and wherein the dealer plays with the dealer Blackjack round hand, the means for playing the Poker round including:

only for each player and the dealer having a bust hand in the Blackjack round, means for dealing up to two additional cards to the player and the dealer, such that each player participating in the Poker round and receiving the up to two additional cards has no more than five cards, wherein each player participating in the Poker round and the dealer have a Poker round hand; and means for determining whether each participating player wins the Blackjack round and the Poker round.

* * * * *